US005478712A

United States Patent [19]

Singer et al.

[11] Patent Number: 5,478,712

[45] Date of Patent: Dec. 26, 1995

[54] PHOTOGRAPHIC ELEMENTS PROTECTED AGAINST COLOR CONTAMINATION AND DYE STAIN

[75] Inventors: Stephen P. Singer, Spencerport; Susan D. Hill, Rochester, both of N.Y.

[73] Assignee: Eastman Kodak Company, Rochester, N.Y.

[21] Appl. No.: 156,337

[22] Filed: Nov. 22, 1993

[51] Int. Cl.[6] ..... G03C 1/08; G03C 7/26; G03C 7/32

[52] U.S. Cl. ..... 430/551; 430/546; 430/214; 430/572; 430/576; 430/585; 430/587

[58] Field of Search ..... 430/546, 384, 430/385, 372, 551, 504, 214, 572, 505, 576, 585, 587

[56] References Cited

U.S. PATENT DOCUMENTS

| | | | |
|---|---|---|---|
| 4,205,987 | 6/1980 | Erikson et al. | 430/216 |
| 4,447,523 | 5/1984 | Ross et al. | 430/505 |
| 4,483,918 | 11/1984 | Sakai et al. | 430/372 |
| 4,525,451 | 6/1985 | Ohki et al. | 430/551 |
| 4,584,263 | 4/1986 | Takahashi | 430/214 |
| 4,584,264 | 4/1986 | Ohki et al. | 430/542 |
| 4,585,728 | 4/1986 | Furutachi et al. | 430/372 |
| 5,188,926 | 2/1993 | Schofield | 430/385 |

FOREIGN PATENT DOCUMENTS 0272604 12/1987 European Pat. Off. .

*Primary Examiner*—Charles L. Bowers, Jr.
*Assistant Examiner*—Geraldine Letscher
*Attorney, Agent, or Firm*—Alfred P. Lorenzo

[57] ABSTRACT

A ballasted amine is incorporated in a silver halide photographic element which contains a 2,4-disulfonamidophenol which functions as a scavenger for oxidized developing agent. The 2,4-disulfonamidophenol serves to avoid color contamination while the ballasted amine serves to reduce dye stain.

20 Claims, No Drawings

PHOTOGRAPHIC ELEMENTS PROTECTED AGAINST COLOR CONTAMINATION AND DYE STAIN

FIELD OF THE INVENTION

This invention relates in general to photography and in particular to color photographic elements comprising radiation-sensitive silver halide emulsion layers. More specifically, this invention relates to an improvement in color photographic elements which contain certain scavengers which prevent oxidized developing agent generated in one layer from diffusing into another layer.

BACKGROUND OF THE INVENTION

Color images are customarily obtained in the photographic art by reaction between the oxidation product of a silver halide color developing agent (i.e., oxidized aromatic primary amino developing agent) and a dye-forming compound known as a coupler. The reaction between coupler and oxidized color developing agent results in coupling of the oxidized color developing agent at a reactive site on the coupler, known as the coupling position, and yields a dye. The dyes typically produced by coupling are indoaniline, azomethine, indamine, or indophenol dyes, depending upon the chemical composition of the coupler and the developing agent. The subtractive process of color image formation is ordinarily employed in multicolor photographic elements and the dyes produced by coupling are usually cyan, magenta or yellow dyes which are formed in or adjacent to silver halide emulsion layers sensitive to radiation absorbed by the image dye, i.e., silver halide emulsion layers sensitive to the red, green or blue regions of the spectrum.

In order to prevent oxidized developing agent generated in one image-forming layer of a color photographic element from diffusing into another layer, it is common to incorporate in the element a compound, referred to as a "scavenger", which reacts with the oxidized developing agent without forming a colored reaction product. Because of their high degree of reactivity and excellent oxidative stability, 2,4-disulfonamidophenols are frequently employed as scavengers. The use of 2,4-disulfonamidophenols, or alkali labile precursors thereof, as scavengers for oxidized developing agent is disclosed, for example, in Ross et al U.S. Pat. No. 4,447,523, issued May 8, 1984.

One deficiency associated with the use of 2,4-disulfonamidophenols as scavengers in photographic systems is that they can cause increased sensitizing dye stain. Sensitizing dyes are ordinarily intended to be washed out or otherwise removed from the photographic element during processing. However, in many cases, sensitizing dye is not fully removed but is retained in the photographic element after processing. This leads to non-imagewise increases in $D_{min}$ because the retained sensitizing dyes are colored, although usually shifted in hue from when they are absorbed on the surface of the silver halide grains. In particular, red sensitizing dyes often exist in two forms in photographic elements, monomeric (magenta colored, $\lambda_{max}$=580 nm) and aggregated (cyan colored, $\lambda_{max}$=640 nm).

A particular problem associated with 2,4-disulfonamidophenols is that they tend to contribute significantly to dye stain caused by red sensitizing dye, for example, they can cause retained red sensitizing dye to aggregate. Normally, retained red sensitizing dye is magenta colored and leads to non-imagewise increases in green density. In the presence of a 2,4-disulfonamidophenol, retained red sensitizing dye can aggregate and become cyan colored. After development, there is a positive image in residual disulfonamidophenol. At no exposure, there is no oxidized developing agent to consume the disulfonamidophenol, whereas at high exposure all of the disulfonamidophenol is consumed. Thus, the retained red sensitizing dye will also form a corresponding positive scale of its aggregated form (cyan in color) and a positive scale of red density. This causes an undesirable increase in red $D_{min}$ and an effective loss in red contrast and speed when the red $D_{min}$ is readjusted to an aim level. This deficiency is a particular problem whenever high levels of red sensitizing dye are used, as is commonly the case with tabular silver halide emulsions. It is also a particular problem with sensitizing dyes that are especially prone to aggregate in the presence of a 2,4-disulfonamidophenol.

The present invention is directed toward the objective of providing a novel photographic element in which a 2,4-disulfonamidophenol is used as a scavenger without causing excessive increases in sensitizing dye stain.

SUMMARY OF THE INVENTION

In accordance with this invention, an improved photographic element includes at least one red-sensitive silver halide emulsion layer containing a sensitizing dye and comprises both a 2,4-disulfonamidophenol, or an alkali labile precursor thereof, which acts as a scavenger for oxidized developing agent and a ballasted amine which serves to reduce dye stain caused by the sensitizing dye; the ballasted amine having a pKa greater than 4.5 and a partition coefficient of at least 5.0.

It has been unexpectedly found that the addition of a ballasted amine to a photographic element, containing a 2,4-disulfonamidophenol as a scavenger for oxidized developing agent, minimizes the formation of stain due to the presence of sensitizing dye, and especially aggregated sensitizing dye, after processing. The amine is ballasted in order to retain it in the layer in which it is coated and prevent unwanted interactions between the amine and other components of the photographic element. Amines which have a relatively high level of basicity are required. Thus the pKa of the ballasted amine should be greater than 4.5, preferably greater than 5.0 and most preferably greater than 5.5. The ballasted amine should be strongly hydrophobic in nature, as indicated by a partition coefficient, as hereinafter defined, of greater than 5.0, more preferably greater than 5.5 and most preferably greater than 6.0.

DETAILED DESCRIPTION OF THE INVENTION

The photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material, the element containing both a 2,4-disulfonamidophenol scavenger and a ballasted amine. Preferably the scavenger and ballasted amine are incorporated in an interlayer between silver halide emulsion layers sensitive to different regions of the visible spectrum, although they can be incorporated in an interlayer between silver halide emulsion layers sensitive to the same region of the visible spectrum. The 2,4-disulfonamidophenol and the ballasted amine can be incorporated in the same or different layers of the photographic element, as desired. They can be incorporated in layers which also have other functions, such as, for example, antihalation layers or filter layers.

In addition to emulsion layers and interlayers, the elements of the present invention can contain auxiliary layers conventional in photographic elements, such as overcoat layers, spacer layers, filter layers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure*, Item 308119, December, 1989.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure*, Item 308119, December, 1989, and the references listed therein.

The photographic silver halide emulsions utilized in this invention can contain other addenda conventional in the photographic art. Useful addenda are described, for example, in *Research Disclosure*, Item 308119, December, 1989. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The 2,4-disulfoamidophenols which are utilized as scavengers in this invention are disclosed in Ross et al, U.S. Pat. No. 4,447,523, issued May 8, 1984. As indicated in this patent, the preferred scavengers are represented by the formula:

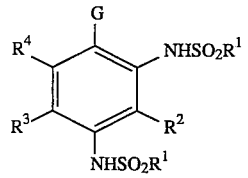

wherein:

G is hydroxy or an alkali labile precursor thereof.

Each $R^1$ is individually alkyl of 1 to 30 carbon atoms, aryl of 6 to 30 carbon atoms or heterocyclyl of 5 to 30 atoms containing one or more ring heteroatoms selected from nitrogen, oxygen, sulfur and selenium; and $R^2$, $R^3$, and $R^4$ are each indivually hydrogen, halogen, alkyl of 1 to 30 carbon atoms, alkoxy of 1 to 30 carbon atoms, aryl of 6 to 30 carbon atoms or aryloxy of 6 to 30 carbon atoms, the scavenger being of sufficient bulk so as to be non-diffusible in the alkali permeable layers of the element.

Especially preferred 2,4-disulfonamidophenol scavengers have the structural formula:

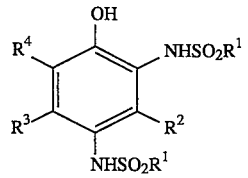

wherein:

Each $R^1$ is individually alkyl of 1 to 30 carbon atoms, or aryl of 6 to 30 carbon atoms; and $R^2$, $R^3$, and $R^4$ are each individually hydrogen, alkyl of 1 to 30 carbon atoms or alkoxy of 1 to 30 carbon atoms.

In particularly preferred scavengers, $R^3$ is alkyl of 1 to 4 carbon atoms or alkoxy of 1 to 4 carbon atoms and $R^2$ and $R^4$ are hydrogen.

As indicated above, the moiety G can be a hydroxy group or an alkali labile precursor of a hydroxy group. In the alkali labile precursors, the hydrogen atom of the hydroxy group is replaced with a blocking group which is removed upon contact with base. Typical blocking groups are removable by hydrolysis or by intramolecular nucleophilic displacement. Typical groups removable by hydrolysis are acyl groups such as aliphatic and aromatic carbonyl and sulfonyl groups. Typical groups removable by intramolecular nucleophilic displacement are described in Mooberry et al, U.S. Pat. No. 4,310,612, issued Jan. 12, 1982.

The alkyl, alkoxy, aryl, and aryloxy substituents described above can be further substituted. Representative such substituents include halogen, nitro, alkyl, aryl, alkenyl, alkoxy, aryloxy, alkenyloxy, heterocyclyl, alkylcarbonyl, arylcarbonyl, alkenylcarbonyl, alkylsulfonyl, arylsulfonyl, alkenylsulfonyl, amino, aminocarbonyl, aminosulfonyl, carboxy, alkoxycarbonyl, aryloxycarbonyl, alkenyloxycarbonyl, sulfo groups and the like. Thus alkyl is inclusive of, e.g., arylalkyl and aryloxyalkyl, aryl is inclusive of, e.g., alkaryl and alkoxyaryl, and alkenyl is inclusive of, e.g., aralkenyl. The amine portions of these further substituents include primary, secondary, and tertiary amines as well as acylated amines.

Examples of 2,4-disulfonamidophenols that are usefully employed as scavengers in the photographic elements of this invention include:

S-1

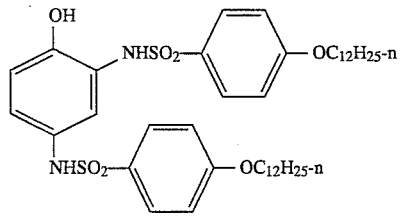

S-2

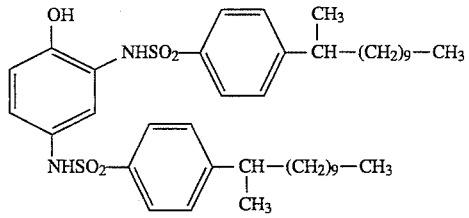

S-3

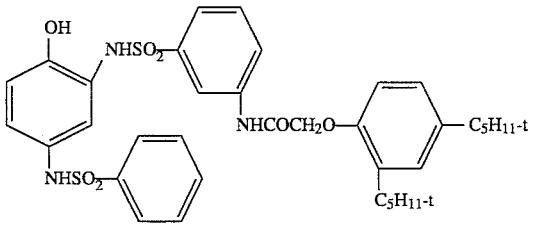

S-4

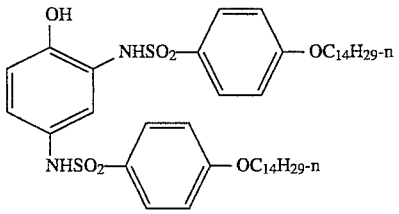

S-5

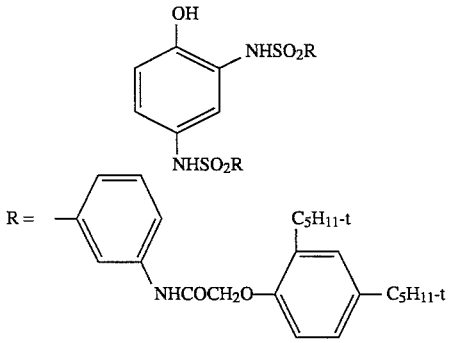

-continued

S-6

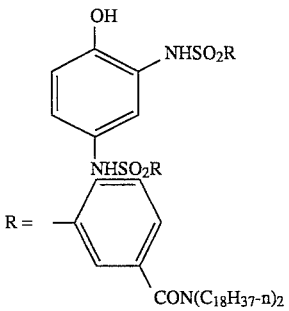

S-7

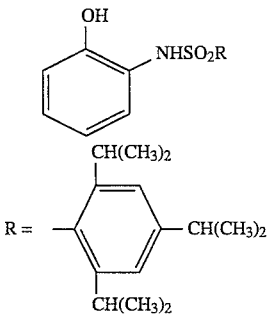

S-8

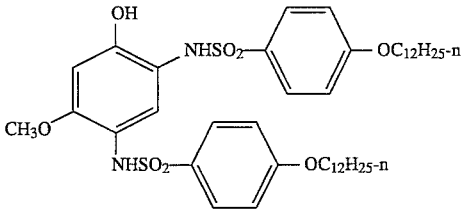

S-9

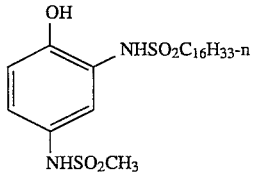

S-10

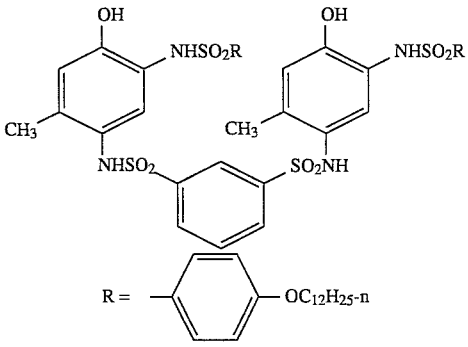

S-11

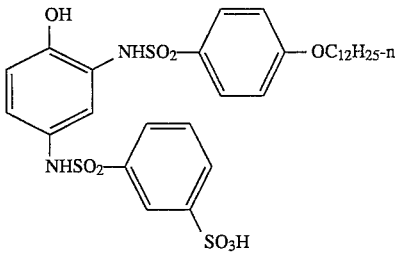

-continued

S-12

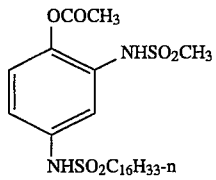

S-13

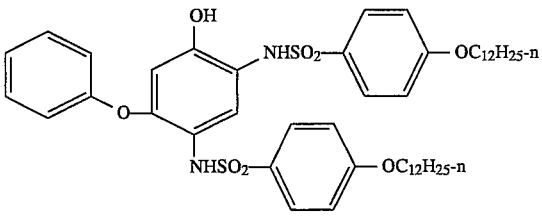

S-14

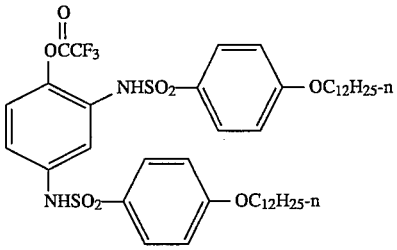

S-15

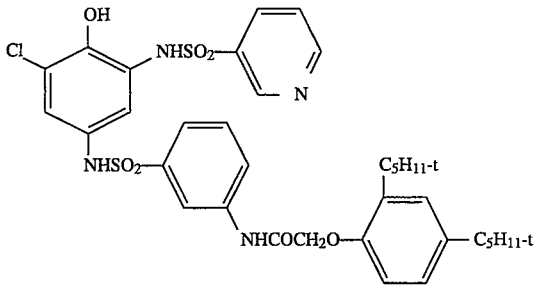

S-16

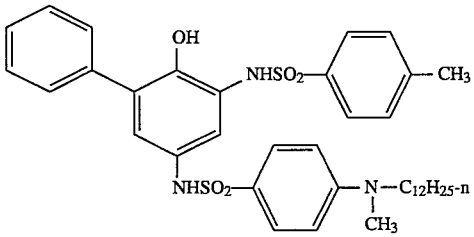

S-17

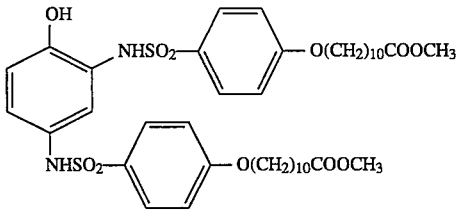

The amount of scavenger compound employed will depend upon the particular purpose for which the scavenger is to be used and the degree of scavenging desired. Typically useful results are obtained when the scavenger is employed in an amount of between about 5 and 2000 mg/square meter.

As hereinabove described, the amine which is utilized in this invention must be ballasted in order to retain it in the layer in which it is coated and prevent unwanted interactions between the amine and other components of the photographic element. Any of a very wide range of ballasted amines can be utilized for the purposes of this invention.

The ballasted amines that are used in this invention have a pKa greater than 4.5, preferably greater than 5.0 and most preferably greater than 5.5, wherein pKa represents the logarithmic value of the reciprocal of the dissociation constant measured at conditions of an ionic strength of 0.1 mols/liter at 25° C. (See, for example, section D-126 in *CRC Handbook of Chemistry and Physics,* 54th Ed.)

A further requirement for the ballasted amines is that they have a partition coefficient of greater than 5.0, more preferably greater than 5.5 and most preferably greater than 6.0.

The term "partition coefficient", as used herein, refers to the log P value of the amine with respect to the system n-octanol/water as defined by the equation:

$$\log P = \log \frac{(X)\text{octanol}}{(X)\text{water}}$$

where X=concentration of the amine. The partition coefficient is a measure of the ability of the amine to partition between aqueous and organic phases and is calculated in the manner described in an article by A. Leo, P. Y. C. Jow, C. Silipo and C. Hansch, *Journal of Medicinal Chemistry*, Vol. 18, No. 9, pp. 865–868, 1975. Calculations for log P can be carried out using MedChem software, version 3.54, Pomona College, Claremont, Calif. The higher the value of log P the more hydrophobic the amine.

Compounds with a log P of greater than zero are hydrophobic, i.e., they are more soluble in organic media than in aqueous media, whereas compounds with a log P of less than zero are hydrophilic. A compound with a log P of one is ten times more soluble in organic media than in aqueous media, and a compound with a log P of two is one hundred times more soluble in organic media than in aqueous media.

Ballasted amines that are useful in this invention encompass compounds of widely varying structure and include aliphatic amines, aromatic amines, cyclic amines, mixed aliphatic-aromatic amines and heterocyclic amines. Primary, secondary and tertiary amines can be usefully employed.

Preferred amines for the purposes of this invention are represented by one of the following generic formulae; it being understood in regard to each such formula that the substituents are so selected that the amine is ballasted, i.e., of sufficient bulk as to be non-diffusible in the alkali permeable layers of the element, has a pKa of greater than 4.5 and a partition coefficient of at least 5.0.

I Acyclic amines of the formula:

$$NR_1R_2R_3$$

wherein $R_1$, $R_2$ and $R_3$ independently represent an alkyl group, substituted or unsubstituted and branched or linear, of 1 to 30 carbon atoms or an aryl group, substituted or unsubstituted, of 6 to 30 carbon atoms.

II Cyclic amines of the formula:

$$R_4—N—R_5R_6$$

wherein $R_4$ is an alkyl group, substituted or unsubstituted and branched or linear, of 1 to 30 carbon atoms or an aryl group, substituted or unsubstituted, of 6 to 30 carbon atoms, and —N—$R_5R_6$ forms a heterocyclic ring system, substituted or unsubstituted, of up to 30 atoms in which the nitrogen atom is bonded to three substituents ($sp^3$ hybridized).

III Cyclic amines of the formula:

$$R_7—N=R_8$$

wherein $R_7$ and $R_8$ together with the nitrogen atom to which they are attached form a heterocylic ring system, substituted or unsubstituted, of up to 30 atoms in which the nitrogen atom is bonded to two substituents ($sp^2$ hybridized).

Examples of ballasted amines that are usefully employed in this invention to minimize dye stain resulting from aggregation of sensitizing dye include:

A-1

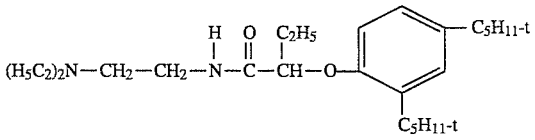

A-2

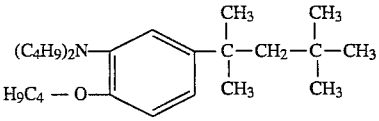

A-3

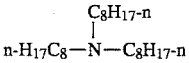

A-4

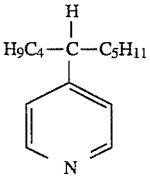

A-5

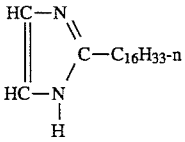

A-6

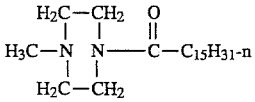

A-7

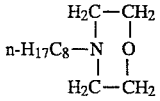

A-8

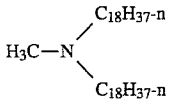

A-9

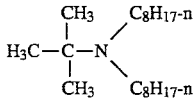

-continued

A-10

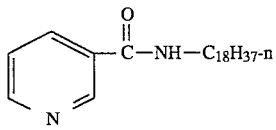

A-11

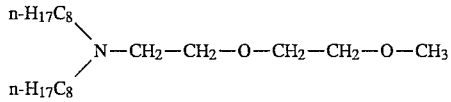

A-12

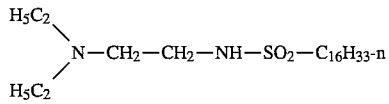

A-13

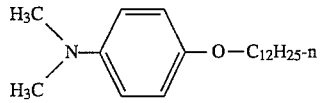

A-14

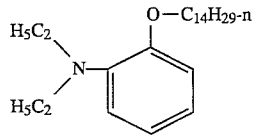

A-15

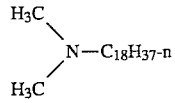

A-16

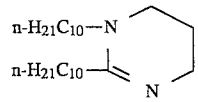

A-17

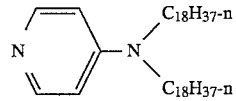

A-18

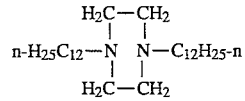

Additional amines that are useful in this invention include amines as described in either U.S. Pat. No. 4,483,918 or U.S. Pat. No. 4,585,728 provided that such amines are so selected as to be ballasted, have a pKa of greater than 4.5 and a partition coefficient of at least 5.0.

The amount of ballasted amine incorporated in the photographic element is not narrowly critical nor is the ratio of ballasted amine to 1,4-disulfonamidophenol narrowly critical. Preferably, the ballasted amine is employed in this invention in an amount of from about 5 to about 2000 mg/$m^2$. Generally, better results are obtained with the use of higher levels of ballasted amine.

The ballasted amine utilized in this invention can be described as photographically inert in the sense that it does not perform an image-forming function. Thus, for example, the ballasted amine does not serve as a coupling agent.

Ballasted amines which are oily liquids can be added as such to an interlayer or other hydrophilic colloid layer of the photographic element. Other ballasted amines can be incorporated with the aid of a suitable solvent such as a coupler solvent. The 2,4-disulfonamidophenols are also typically incorporated in the photographic element with the aid of a coupler solvent. When the ballasted amine is an oily liquid, it can serve as a suitable organic solvent for incorporation of the 2,4-disulfonamidophenol.

Examples of preferred coupler solvents that can be utilized in this invention to incorporate the scavenger and/or ballasted amine in the photographic element include:

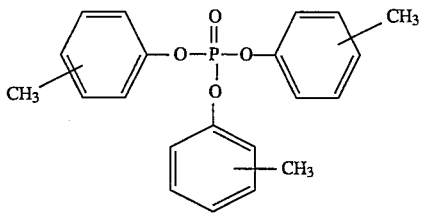

CS-1

(mixture of ortho, meta and para isomers)

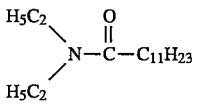

CS-2

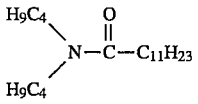

CS-3

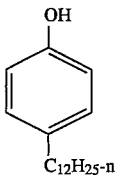

CS-4

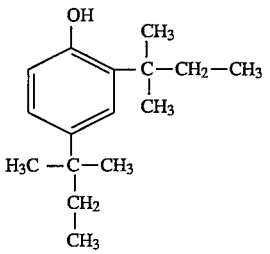

CS-5

$O{=}P(OC_6H_{13}\text{-}n)_3$

CS-6

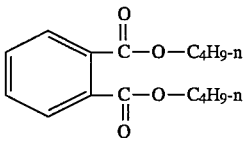

CS-7

In the practice of this invention, it is desirable to incorporate a surfactant in the layer containing the ballasted amine. Because ballasted amines can complex surfactants and thereby cause surface tension changes which can adversely affect coating properties, the surfactant is typically employed at a relatively high concentration. Preferred amounts are at least one percent by weight, based on the ballasted amine, more preferably at least ten percent by weight and most preferably at least twenty percent by weight. Examples of useful surfactants include nonionic surfactants such as SURFACTANT 10G from OLIN MATHIESON CORPORATION and anionic surfactants such as TRITON X-200E from ROHM AND HAAS CORPORATION or AEROSOL TO from AMERICAN CYANAMID COMPANY.

The problem of sensitizing dye stain, which is minimized or avoided by the use of a ballasted amine in accordance with this invention, is particularly severe with photographic elements utilizing tabular grain silver halide emulsions because such emulsions typically employ very high levels of sensitizing dye. However, because of their other advantageous characteristics use of tabular grain silver halide emulsions represents a particularly important embodiment of this invention.

Specifically contemplated tabular grain emulsions for use in this invention are those in which greater than 50 percent of the total projected area of the emulsion grains is accounted for by tabular grains having a thickness of less than 0.3 micron and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above, tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

The problem of sensitizing dye stain, which is minimized or avoided by the use of a ballasted amine in accordance with this invention, is particularly severe with photographic elements which utilize a thiacyanine dye to increase the sensitivity of a silver halide emulsion to red light because such dyes are very prone to aggregate. These dyes are advantageous, however, because they have many other useful characteristics. The use of thiacyanine sensitizing dyes is well known in the art and is described, for example, in U.S. Pat. Nos. 3,463,640 and 3,522,052.

In a particular novel aspect, the silver halide photographic elements of this invention comprise a 2,4-disulfonamidophenol, a ballasted amine and a thiacyanine sensitizing dye which functions to sensitize a silver halide emulsion in a red-sensitive layer, wherein the thiacyanine dye is represented by the formula:

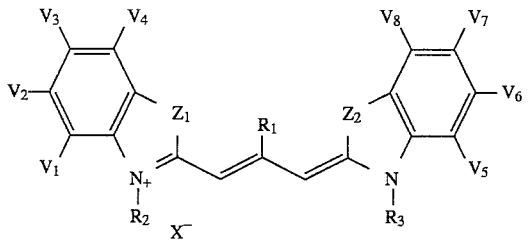

wherein $Z_1$ represents a sulfur or a selenium atom;

$Z_2$represents a sulfur or selenium atom or —$NR_4$;

$R_1$ represents a hydrogen atom or an unsubstituted or substituted alkyl group;

$R_2$, $R_3$ and $R_4$ each independently represent an unsubstituted or substituted alkyl or alkenyl group of less than 18 carbon atoms;

$V_1$, $V_2$, $V_3$, $V_4$, $V_5$, $V_6$, $V_7$ and $V_8$ each represent a hydrogen atom, a halogen atom, an alkyl group, an alkyloxy group, an aryl group, a heterocyclic group (such as furanyl), a cyano group, a hydroxy group, an amino group, a carbonamido group, a trifluoromethyl group, an acyloxy group, an alkylthio group or may be connected to form one or more additional aromatic rings; and X represents a counterion, if necessary to balance the overall charge of the dye.

$R_1$ represents a hydrogen or a substituted or unsubstituted alkyl group, preferably containing 1–4 carbon atoms. Preferred examples of alkyl groups include methyl, ethyl, propyl, butyl, 2-methoxyethyl, 2-ethoxyethyl, methoxymethyl, ethoxymethyl, benzyl, p-methoxybenzyl, p-chlorobenzyl and 2-chloroethyl.

$R_2$, $R_3$ and $R_4$ are each independently a substituted or unsubstituted alkyl or alkenyl group, preferably having 1–18 carbon atoms. It is preferred that at least one of $R_2$, $R_3$ and $R_4$ contain an acid solubilizing group such as carboxy (—$CO_2^-$), sulfo ($SO_3^-$), phosphono(—$PO_3H_2$), sulfato (—$OSO_3$—), sulfocarbonamido (—$CONHSO_2$—) or imido (—CONHCO—). Further, additional solubilizing groups such as hydroxy, sulfonamido or carbonamido may be present. Preferred examples include ethyl, propyl, butyl, 3-sulfopropyl, 3-sulfobutyl, 4-sulfobutyl, and 2-hydroxy-3-sulfopropyl.

Preferred $V_1$–$V_8$ groups include H, methyl, chloro, phenyl, furanyl or annuated benzene rings.

Preferred X ions are salts of sodium, potassium, triethylamine, pyridine, tetramethyl guanidine, morpholine, N-ethylpiperidine or N-ethylpyridinium.

In preferred thiacyanine dyes, $Z_1$ represents a sulfur atom and $Z_2$ represents a sulfur or selenium atom. In particularly preferred dyes, each of $Z_1$ and $Z_2$ represents a sulfur atom. Preferably the dye molecule contains a solubilizing group attached to the nitrogen atom of one of the thiazole rings and more preferably it contains a solubilizing group attached to the nitrogen atoms of each thiazole ring.

Examples of thiacyanine dyes which can be used as sensitizing dyes in the red-sensitive layer(s) of the photographic elements of this invention include:

DYE-1

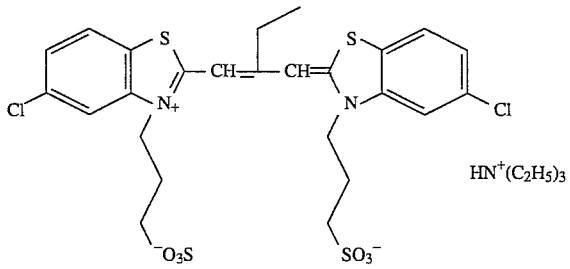

DYE-2

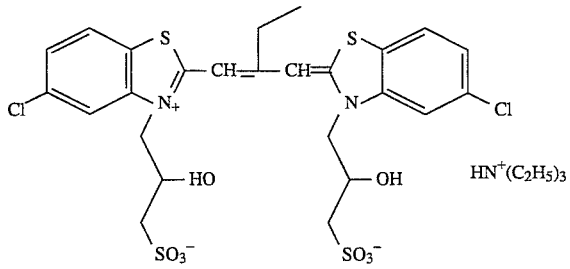

-continued
DYE-3
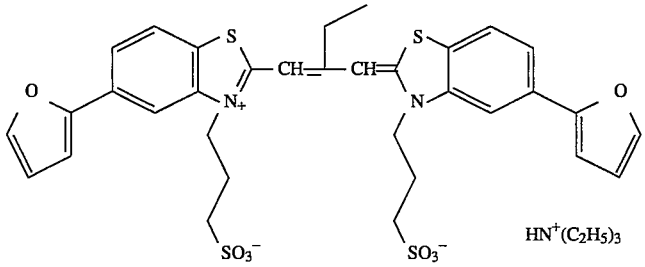
DYE-4
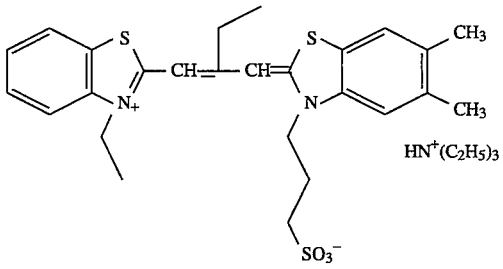
DYE-5
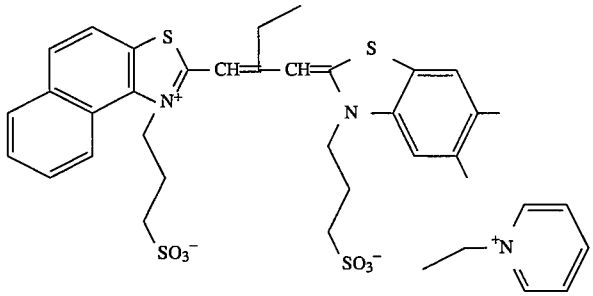
DYE-6
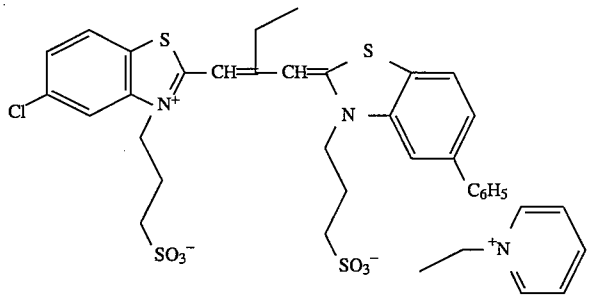
DYE-7
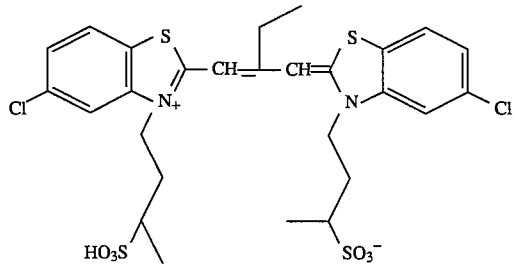
DYE-8
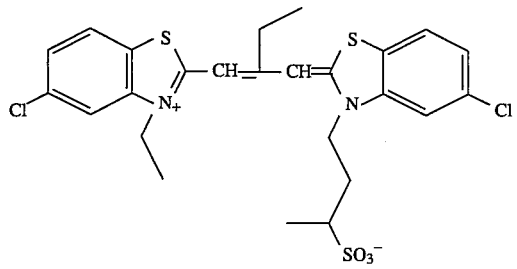

-continued

DYE-9

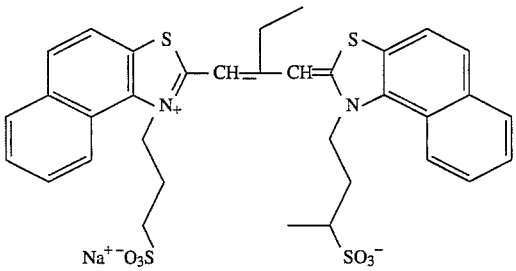

DYE-10

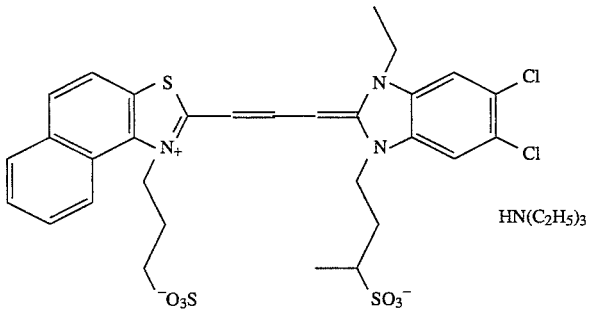

DYE-11

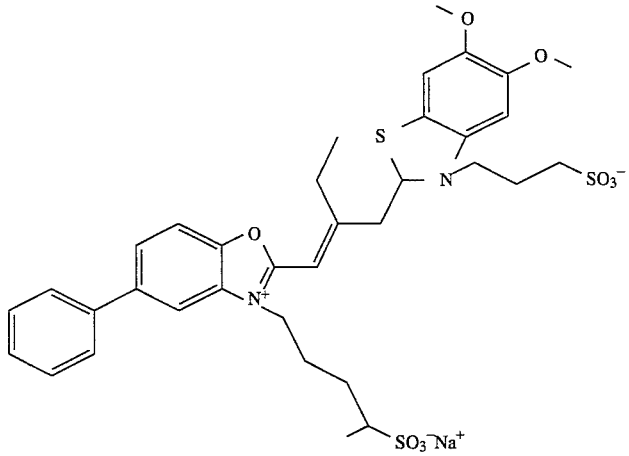

The amount of thiacyanine sensitizing dye utilized is typically from about 0.1 mmol to about mmol per mole of silver , more preferably from about 0.3 mmol to about 3 mmol per mole of silver.

In a particularly preferred embodiment, the present invention provides a multicolor photographic element capable of forming a dye image, which element comprises a support having thereon:

a blue-recording yellow-dye-image forming layer unit, a green-recording magenta-dye-image-forming layer unit, and a red-recording cyan-dye-image-forming layer unit, each of the dye-image-forming layer units comprising at least one silver halide emulsion layer containing at least one sensitizing dye; the element comprising at least one interlayer positioned between dye-image-forming layer units sensitive to different regions of the visible spectrum and the at least one interlayer containing both a 2,4-disulfonamidophenol, or an alkali labile precursor thereof, which acts as a scavenger for oxidized developing agent and a ballasted amine which serves to reduce dye stain caused by sensitizing dye, the ballasted amine having a pKa greater than 4.5 and a partition coefficient of at least 5.0.

The photographic elements of this invention can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(b-(methanesulfonamido) ethyl)aniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

In the working examples which follow, reference is made to antihalation dyes D-1, D-2, D-3 and D-4, cyan-dye-forming couplers C-1 and C-2, magenta-dye-forming couplers M-1 and M-2, yellow-dye-forming couplers Y-1, Y-2 and Y-3, bleach-accelerator-releasing coupler B-1, masking couplers CM-1 and CM-2, developer-inhibitor-releasing couplers DIR-1, DIR-2 and DIR-3, ultraviolet absorber UV-1, red-sensitizing dyes RSD-1 and RSD-2, green-sensitizing dyes GSD-1 and GSD-2, blue-sensitizing dye YSD-1 and yellow filter dye YFD-1. These compounds have structures as indicated below:

D-1

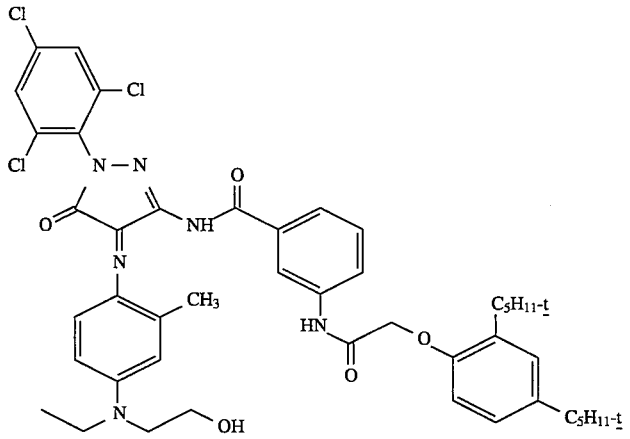

D-2

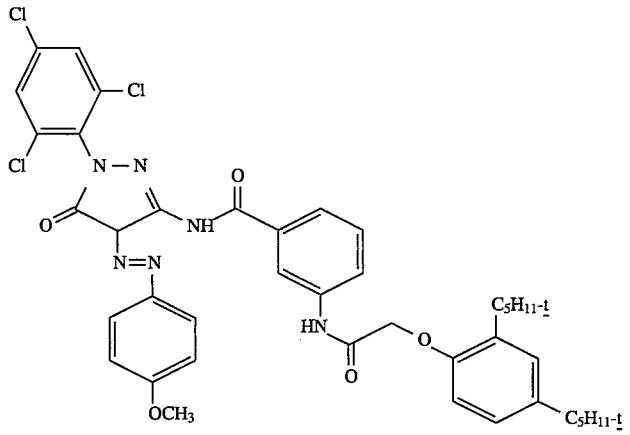

D-3

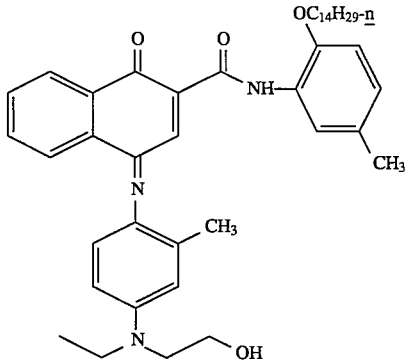

D-4

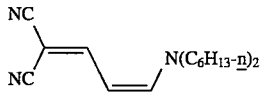

-continued
C-1
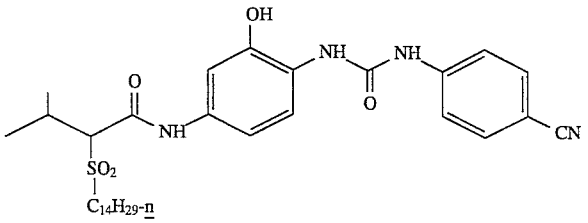
C-2
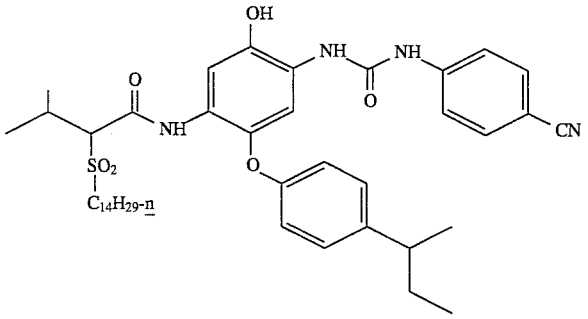
M-1
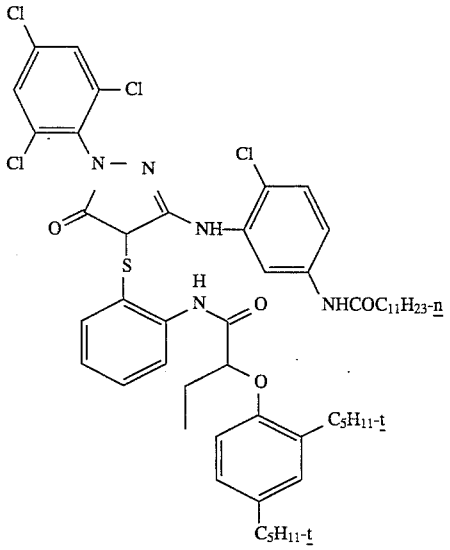
M-2
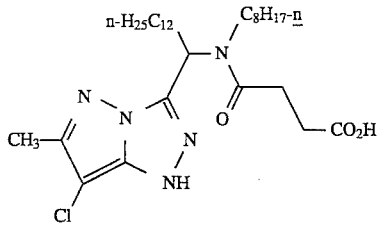

-continued
Y-1
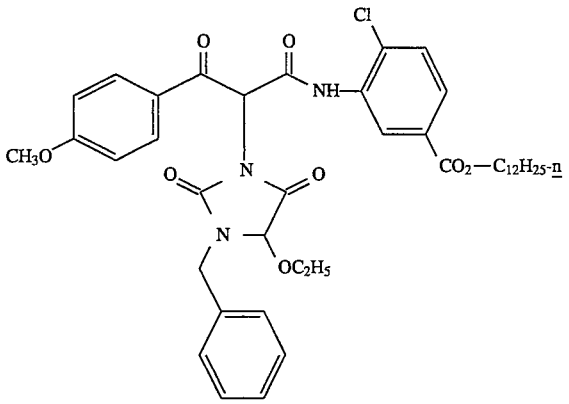
Y-2
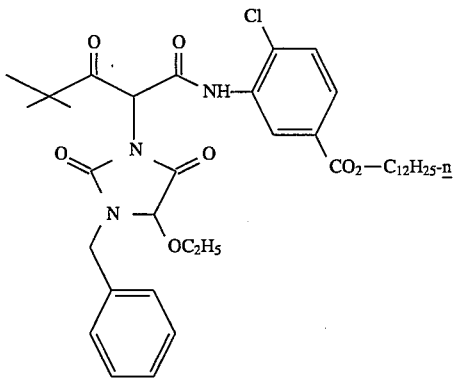
Y-3
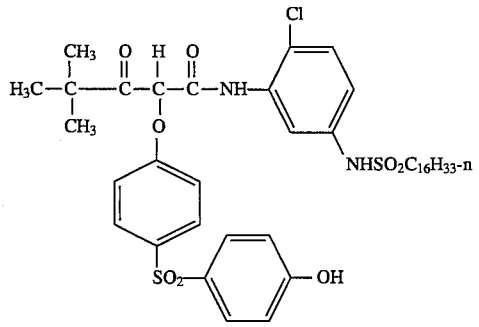
B-1
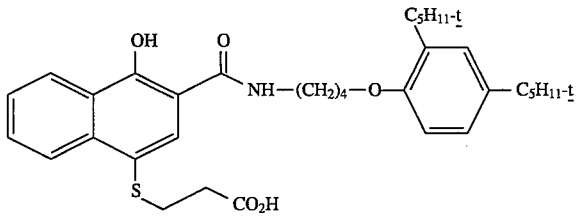

-continued
CM-1
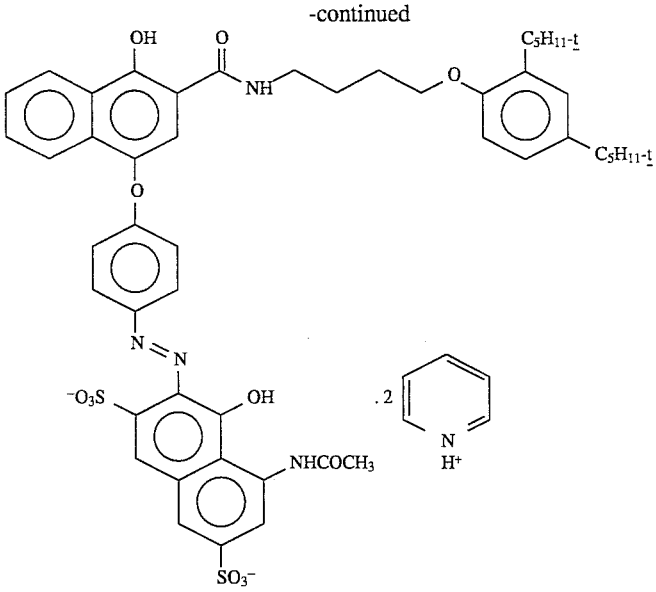
CM-2
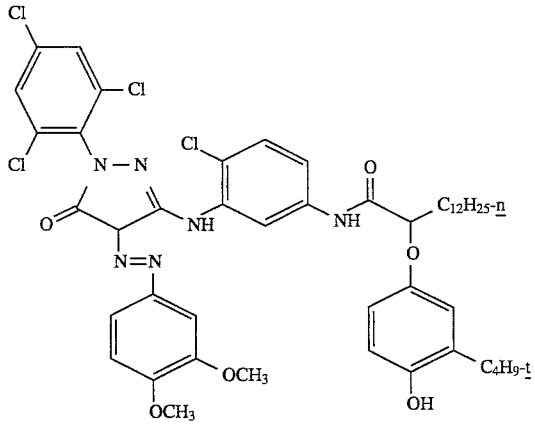
DIR-1
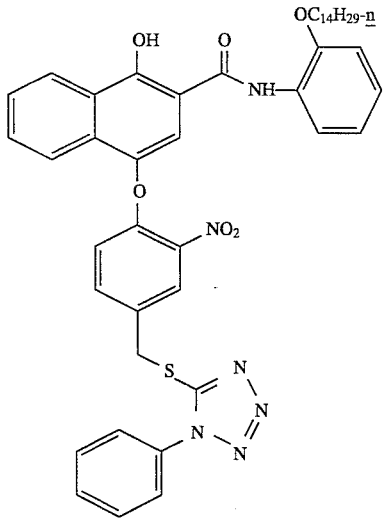

-continued
DIR-2
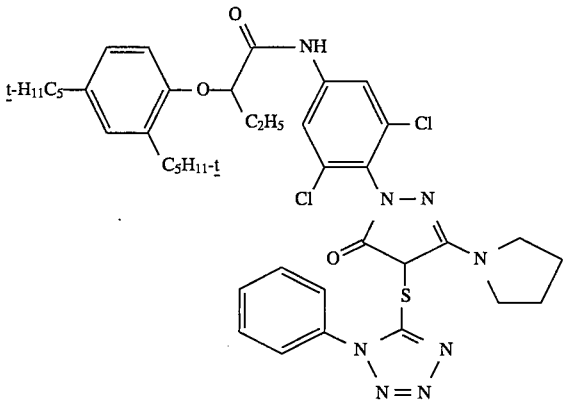
DIR-3
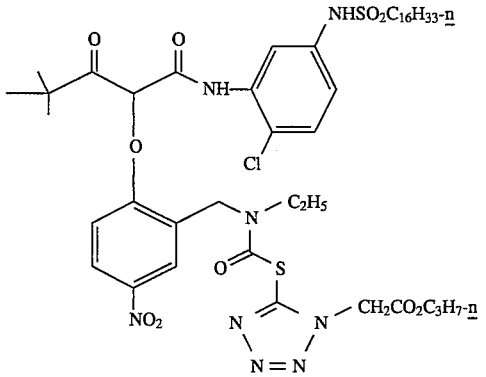
UV-1
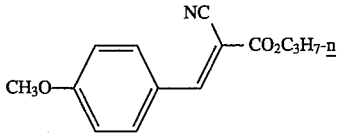
RSD-1
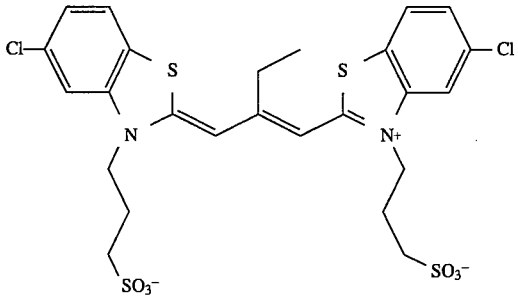
RSD-2
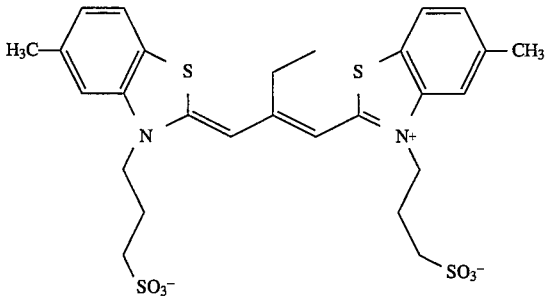

-continued

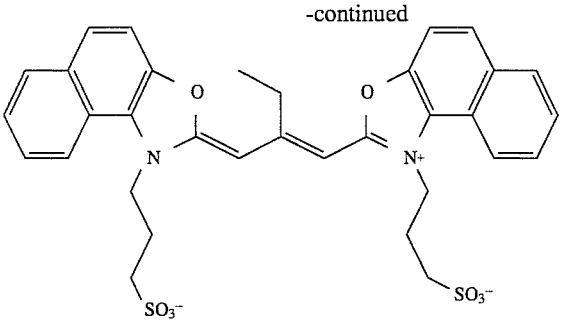

GSD-1

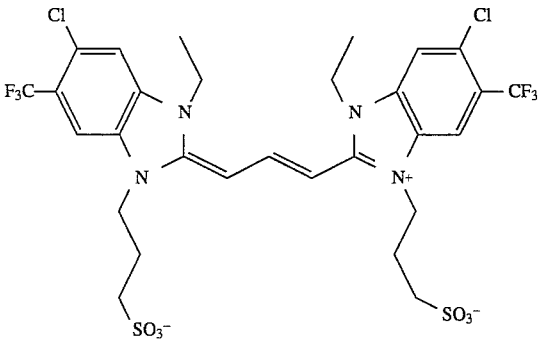

GSD-2

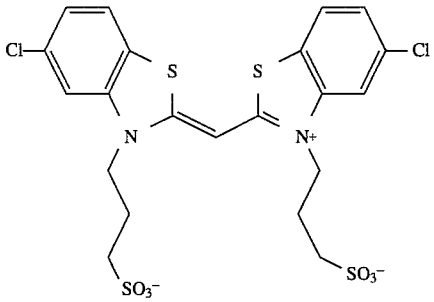

YSD-1

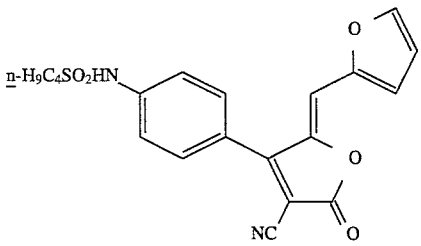

YFD-1

The following examples illustrate the ability of ballasted amines, when used in conjunction with 2,4-disulfonamidophenols, to reduce dye stain due to aggregation of thiacyanine sensitizing dye used in the red-sensitive layer of a photographic element. In the examples, ballasted amine A-1 has a pKa of 10.0 and a partition coefficient of 7.7, ballasted amine A-2 has a pKa of 6.2 and a partition coefficient of 10.4, ballasted amine A-3 has a pKa of 10.6 and a partition coefficient of 10.7, ballasted amine A-4 has a pKa of 6.9 and a partition coefficient of 5.3, ballasted amine A-5 has a pKa of greater than 4.5 and a partition coefficient of 7.5 and ballasted amine A-6 has a pKa of 7.0 and a partition coefficient of 7.4.

EXAMPLES 1–19

To evaluate the effectiveness of ballasted amines in minimizing dye stain resulting from aggregation of sensitizing dye, a color negative test format was employed in accordance with the following schematic representation:

| | | |
|---|---|---|
| Overcoat Layer | Gelatin | 5.38 gm/m$^2$ |
| | Hardener | 1.75 wt % |
| Receiver Layer | Gelatin | 2.69 gm/m$^2$ |
| | Magenta coupler | 530 mmol/m$^2$ |
| Interlayer | Gelatin | 0.65 g/m$^2$ |
| | Scavenger | 7 mmol/m$^2$ |
| Causer Layer | Gelatin | 2.15 g/m$^2$ |
| | Yellow coupler | 1240 mmol/m$^2$ |
| | Silver halide | 2.42 g/m$^2$ |
| | First Sensitizing dye | 0.29 g/mol Ag |

-continued

| | |
|---|---|
| Second Sensitizing dye | 1.22 g/mol Ag |
| Antifoggant | 1.75 g/mol Ag |
| Film Support | |

In this element, the hardener is bis(vinylsulfonylmethyl-)ether, the silver halide grains are thin tabular silver bromoiodide grains (4.125 mole % iodide) with an average thickness of 0.065 micrometers, the antifoggant is 4-hydroxy-6-methyl-1,3,3a,7-tetraazaindene, the scavenger is a 2,4-disulfonamidophenol as indicated in Table I below, the magenta coupler is M-2, the yellow coupler is coupler Y-3, the first sensitizing dye is DYE-11, and the second sensitizing dye is dye RSD-1.

In the test format described above, the causer layer, which contains a yellow coupler and a red-sensitized silver halide emulsion, generates excess oxidized developing agent which diffuses through the interlayer to a receiver layer which contains a magenta coupler but no silver halide. The scavenger, which is incorporated in the interlayer, functions to prevent oxidized developing agent from reaching the receiver layer, thus reducing the amount of magenta coupler and green density formed. The only source of red density in this format is aggregated red sensitizing dye.

In accordance with the present invention, a ballasted amine is incorporated in the interlayer along with the scavenger. The couplers, scavenger and ballasted amine are incorporated in the test element using conventional coupler solvents. The ballasted amine was either codispersed with the scavenger or added as a separate dispersion.

Test elements as described above, containing scavengers and ballasted amines as indicated in Table I below, were exposed through a graduated density test object and processed, using two different processes. PROCESS A is a KODAK C-41 Process (as described in *The British Journal of Photography Annual of* 1982, pages 209–211 and 1988, pages 191–198) which is "flooded", that is all baths are continuously renewed. PROCESS B is also a KODAK C-41 Process but one in which replenishment of the baths is minimized in order to allow full seasoning of film reaction products in each bath. In a continuously renewed process, like PROCESS A, fresh baths tend to maximize sensitizing dye washout and minimize dye aggregation regardless of the presence of a scavenger. A seasoned process, like PROCESS B, tends to promote sensitizing dye aggregation.

In the experimental data reported in Table I, the formation of aggregated sensitizing dye after processing was monitored by the red density at minimum exposure. Greater red density indicates more red sensitizing dye present in the aggregated form. Activity was monitored by the amount of green density formed at maximum exposure. Less green density indicates a more active interlayer scavenger.

Interlayer compositions described in Table I specify the weight ratio of scavenger, ballasted amine and coupler solvent. Thus, an interlayer composition specified as 1:0.4:0.1 S-1/CS-3/A-1 refers to an interlayer comprised of gelatin having dispersed therein scavenger S-1, ballasted amine A-1 and coupler solvent CS-3 at a weight ratio of 1 part of S-1 to 0.4 parts of CS-3 to 0.1 parts of A-1. In the experiments reported in Table I, the ballasted amine was codispersed with the scavenger in each of examples 1 to 16 and the ballasted amine was added as a separate dispersion in each of Examples 17, 18 and 19.

TABLE I

| | | PROCESS A | | PROCESS B | |
|---|---|---|---|---|---|
| Example No. | Interlayer Composition | Green Dmax | Red Dmax | Green Dmax | Red Dmax |
| Control 1 | Gelatin | 0.784 | 0.203 | 0.776 | 0.262 |
| Control 2 | 1:0.5 S-1/CS-3 | 0.566 | 0.242 | 0.562 | 0.292 |
| Example 1 | 1:0.25:0.25 S-1/CS-3/A-1 | 0.577 | 0.223 | 0.573 | 0.283 |
| Example 2 | 1:0.4:0.1 S-1/CS-3/A-1 | 0.573 | 0.236 | 0.568 | 0.284 |
| Example 3 | 1:0.45:0.05 S-1/CS-3/A-1 | 0.565 | 0.242 | 0.561 | 0.289 |
| Example 4 | 1:0.5:0.5 S-1/CS-3/A-1 | 0.571 | 0.190 | 0.571 | 0.255 |
| Example 5 | 1:0.9:0.1 S-1/CS-3/A-1 | 0.561 | 0.222 | 0.561 | 0.273 |
| Example 6 | 1:0.5:0.5 S-1/CS-3/A-2 | 0.559 | 0.227 | 0.559 | 0.280 |
| Example 7 | 1:0.9:0.1 S-1/CS-3/A-2 | 0.553 | 0.226 | 0.557 | 0.269 |
| Example 8 | 1:0.5:0.5 S-1/CS-3/A-3 | 0.567 | 0.176 | 0.568 | 0.241 |
| Example 9 | 1:0.5:0.5 S-1/CS-3/A-4 | 0.555 | 0.182 | 0.552 | 0.250 |
| Example 10 | 1:0.5:0.5 S-1/CS-3/A-1 | 0.577 | 0.192 | 0.574 | 0.269 |
| Example 11 | 1:0.5:0.5 S-2/CS-3/A-1 | 0.599 | 0.169 | 0.602 | 0.238 |
| Example 12 | 1:0.5:0.05 S-1/CS-3/A-5 | 0.566 | 0.200 | 0.574 | 0.268 |
| Example 13 | 1:0.5:0.05 S-1/CS-3/A-6 | 0.564 | 0.193 | 0.559 | 0.270 |
| Example 14 | 1:1 S-1/A-1 | 0.581 | 0.151 | 0.578 | 0.243 |
| Example 15 | 1:1 S-1/A-3 | 0.579 | 0.155 | 0.581 | 0.233 |
| Example 16 | 1:1 S-1/A-2 | 0.547 | 0.218 | 0.547 | 0.287 |
| Example 17 | 1:0.5:0.5 S-1/CS-3/A-1 | 0.567 | 0.178 | 0.566 | 0.274 |
| Example 18 | 1:0.5:0.5 S-1/CS-3/A-3 | 0.545 | 0.153 | 0.545 | 0.231 |
| Example 19 | 1:0.5:0.5 S-1/CS-3/A-2 | 0.556 | 0.214 | 0.545 | 0.285 |

The data reported in Table I indicate that adding a scavenger to the interlayer reduces green Dmax but increases red Dmax (compare Control 1 with Control 2). The scavenger reduces green Dmax because it prevents oxidized developing agent from reaching the receiver layer. However, it causes an unwanted increase in red Dmax because it causes additional retained red sensitizing dye to aggregate. Note that Control 1 has some red density due to non-imagewise aggregation of the red sensitizing dye. The additional incorporation of a ballasted amine in the interlayer results in a lower red Dmax (compare Example 1 with Control 2), but has no significant adverse effect on green Dmax. This is because the ballasted amine minimizes formation of stain due to aggregated red sensitizing dye while having little or no adverse effect on activity.

As indicated by the data in Table I, alkylamines, such as A-1 and A-3, are more effective than pyridines, such as A-4, which in turn are more effective than anilines, such as A-2.

EXAMPLES 20–21

A multilayer photographic element, referred to herein as Control 3, was prepared by coating the following twelve layers on a cellulose triacetate film support. In each instance the coverage specified is in grams per square meter and the silver halide grain size reported in micrometers refers to diameter times thickness.

Layer 1 (Antihalation layer): black colloidial silver sol at 0.161; Dyes D-1 at 0.070, D-2 at 0.036, D-3 at 0.014 and D-4 and gelatin at 2.15.

Layer 2 (First Interlayer): Oxidized developer scavenger S-1 at 0.054 and gelatin at 0.646.

Layer 3 (Slow cyan layer): a blend of two red sensitized (both with a mixture of RSD-1 and RSD-2) silver iodobromide emulsions: (i) a large sized tabular grain emulsion (0.50×0.085, 1.5 mole % I) at 0.323 and (ii) a smaller tabular emulsion (1.16×0.052, 5.1 mole % I) at 0.570; gelatin at 2.58; cyan dye-forming coupler C-1 at 0.646; DIR coupler DIR-1 at 0.038; bleach accelerator releasing coupler B-1 at 0.054, antifoggant 4-hydroxy-6-methyl-1,3,3a,7-tetraazaindene at 0.016 and gelatin at 2.582.

Layer 4 (Fast cyan layer): a red-sensitized (same as above) tabular silver iodobromide emulsion (1.99×0.063, 5.1 mole % I) at 0.4430; cyan coupler C-2 at 0.118; DIR-1 at 0.027; masking coupler CM-1 at 0.032; gelatin at 1.29 and antifoggant 4-hydroxy-6-methyl-1,3,3a,7-tetraazaindene at 0.006.

Layer 5 (Second Interlayer): oxidized developer scavenger S-1 at 0.054 and gelatin at 0.646.

Layer 6 (Slow magenta layer): a green sensitized (with a mixture of GSD-1 and GSD-2) tabular silver iodobromide emulsion (0.5×0.085, 1.5 mole % iodide) at 0.161; magenta dye forming coupler M-1 at 0.215; gelatin at 0.807 and antifoggant 4-hydroxy-6-methyl-1,3,3a,7-tetraazaindene at 0.001.

Layer 7 (Mid magenta layer): a blend of two green sensitized (same as above) tabular silver iodobromide emulsions (i) 1.75×0.049, 7.05 mole % iodide and (ii) 1.20×0.054, 6.2 mole % I) at a total of 0.463; M-1 at 0.247; M-2 at 0.075; CM-2 at 0.129; DIR-1 at 0.032; DIR-2 at 0.005; gelatin at 1.02 and 4-hydroxy-6-methyl-1,3,3a,7-tetraazaindene at 0.003.

Layer 8 (Fast magenta layer): a green sensitized (same as above) tabular silver iodide emulsion (1.99×0.063, 5.1% iodide) at 0.430; M-2 at 0.086; CM-2 at 0.043; DIR-2 at 0.001; gelatin at 1.01 and 4-hydroxy-6-methyl-1,3,3a,7-tetraazaindene at 0.006.

Layer 9 (Yellow filter layer): gelatin at 0.646; YFD-1 at 0.108 and S-1 at 0.054.

Layer 10 (Slow yellow layer): a blend of three blue sensitized (all with YSD-1) tabular silver iodobromide emulsions ((i) 2.00×0.062, 3.15 mole % I (ii) 1.19×0.046, 3.0 mole % I and (iii) 0.5×0.080, 1.5 mole % I) at a total of 0.387; yellow dye forming coupler Y-1 at 0.215; Y-2 at 0.968; DIR-3 at 0.032; B-1 at 0.005, 4-hydroxy-6-methyl-1,3,3a,7-tetraazaindene at 0.006 and gelatin at 1.775.

Layer 11 (Fast yellow layer): a blue sensitized (with YSD-1) tabular silver iodobromide emulsion (2.79×0.072, 2.7 mole % I) at 0.322; Y-1 at 0.075; Y-2 at 0.344; DIR-3 at 0.064; 4-hydroxy-6-methyl-1,3,3a,7-tetraazaindene at 0.005 and gelatin at 1.08.

Layer 12 (Protective overcoat and UV filter layer): gelatin at 1.08; silver bromide Lippman emulsion at 0.108; D-4 and UV-1 (1:1 ratio) at a total of 0.023 and bis(vinylsulfonyl-)methane hardener at 1.8% of total gelatin weight.

In each of layers 2, 5 and 9, the scavenger was added as a dispersion of 1 part by weight of S-1 to 0.5 parts of the coupler solvent N,N-diethyllauramide.

Surfactants (a mixture of TRITON X-200E and OLIN 10G), coating aids, emulsion addenda, matte and tinting dyes were added to the appropriate layers as is common in the art.

An otherwise identical multilayer photographic element, referred to as Example 20, was prepared in which there was added to layers 2, 5 and 9 a dispersion of one part by weight of S-1 to 0.5 parts of N,N-dibutylauramide to 0.5 parts of ballasted amine A-4 along with 0.005 parts of surfactant AEROSOL TO.

An otherwise identical multilayer photographic element, referred to as Example 21, was prepared in which there was added to layers 2, 5 and 9 a dispersion of one part by weight of S-1 to 0.5 parts of N,N-dibutylauramide to 0.5 parts of ballasted amine A-3 along with 0.005 parts of surfactant AEROSOL TO.

The multilayer photographic elements of Control 3, Example 20 and Example 21 were given a stepped exposure and processed in PROCESS B as described above. The results obtained are reported in Table II and clearly indicate that addition of the ballasted amines of this invention lowers red $D_{min}$ and minimizes aggregation of retained sensitizing dye.

TABLE II

| Example No. | Scavenger | Ballasted Amine | Red $D_{min}$ |
|---|---|---|---|
| Control 3 | S-1 | None | 0.284 |
| Example 20 | S-1 | A-4 | 0.259 |
| Example 21 | S-1 | A-3 | 0.251 |

In summary, the present invention provides novel color photographic elements protected against both color contamination and dye stain. Protection against color contamination is provided by incorporation in the element of a 2,4-disulfonamidophenol which acts as a scavenger for oxidized developing agent, thereby preventing it from diffusing from one color record into another color record and thereby causing color contamination. Protection against dye stain is provided by the additional incorporation in the element of a ballasted amine which acts to minimize stain, such as, for example, by preventing aggregation of red sensitizing dye caused by the 2,4-disulfonamidophenol. Ballasted amines which have a relatively high degree of basicity and which are highly hydrophobic in nature are most effective for this purpose.

The invention has been described in detail, with particular reference to certain preferred embodiments thereof, but it should be understood that variations and modifications can be effected within the spirit and scope of the invention.

We claim:

1. A photographic element comprising at least one red-sensitive silver halide emulsion layer containing a sensitizing dye, said element comprising a 2,4-disulfonamidophenol, or an alkali labile precursor thereof, which acts as a scavenger for oxidized developing agent and a ballasted amine which serves to reduce dye stain caused by said sensitizing dye; said ballasted amine having a pKa greater than 4.5 and a partition coefficient of at least 5.0.

2. A photographic element as claimed in claim 1, wherein said ballasted amine has a pKa of greater than 5.0.

3. A photographic element as claimed in claim 1, wherein said ballasted amine has a pKa of greater than 5.5.

4. A photographic element as claimed in claim 1, wherein said ballasted amine has a partition coefficient of at least 5.5.

5. A photographic element as claimed in claim 1, wherein said ballasted amine has a partition coefficient of at least 6.0.

6. A photographic element as claimed in claim 1, which further comprises at least one green-sensitive silver halide emulsion layer and at least one blue-sensitive silver halide emulsion layer.

7. A photographic element as claimed in claim 1, wherein said sensitizing dye is a thiacyanine.

8. A photographic element as claimed in claim 1, wherein both said scavenger and said ballasted amine are incorporated in an interlayer of said element and said interlayer additionally contains a nonionic or anionic surfactant.

9. A photographic element as claimed in claim 1, wherein said scavenger is represented by the formula:

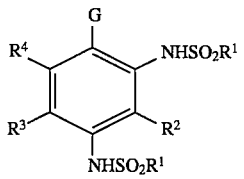

wherein:

G is hydroxy or an alkali labile precursor thereof;

each $R^1$ is individually alkyl of 1 to 30 carbon atoms, aryl of 6 to 30 carbon atoms or heterocyclyl of 5 to 30 atoms containing one or more ring heteroatoms selected from nitrogen, oxygen, sulfur and selenium; and $R^2$, $R^3$, and $R^4$ are each individually hydrogen, halogen, alkyl of 1 to 30 carbon atoms, alkoxy of 1 to 30 carbon atoms, aryl of 6 to 30 carbon atoms or aryloxy of 6 to 30 carbon atoms, the scavenger being of sufficient bulk so as to be non-diffusible in the alkali permeable layers of the element.

10. A photographic element as claimed in claim 1, wherein said scavenger is represented by the formula:

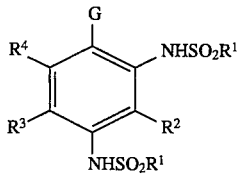

wherein:

each $R^1$ is individually alkyl of 1 to 30 carbon atoms or aryl of 6 to 30 carbon atoms; and $R^2$, $R^3$, and $R^4$ are each individually hydrogen, alkyl of 1 to 30 carbon atoms, or alkoxy of 1 to 30 carbon atoms.

11. A photographic element as claimed in claim 1, wherein said ballasted amine is represented by one of the following formulae:

$$NR_1R_2R_3 \qquad \text{I}$$

wherein $R_1$, $R_2$ and $R_3$ independently represent an alkyl group, substituted or unsubstituted and branched or linear, of 1 to 30 carbon atoms or an aryl group, substituted or unsubstituted, of 6 to 30 carbon atoms.

$$R_4—N—R_5R_6 \qquad \text{II}$$

wherein $R_4$ is an alkyl group, substituted or unsubstituted and branched or linear, of 1 to 30 carbon atoms or an aryl group, substituted or unsubstituted, of 6 to 30 carbon atoms, and —N—$R_5R_6$ forms a heterocyclic ring system, substituted or unsubstituted, of up to 30 atoms in which the nitrogen atom is bonded to three substitutents;

$$R_7—N=R_8 \qquad \text{III}$$

wherein $R_7$ and $R_8$ together with the nitrogen atom to which they are attached form a heterocyclic ring system, substituted or unsubstituted, of up to 30 atoms in which the nitrogen atom is bonded to two substituents 12. A photographic element as claimed in claim 1, wherein said red-sensitive silver halide emulsion layer comprises a thiacyanine sensitizing dye of the formula:

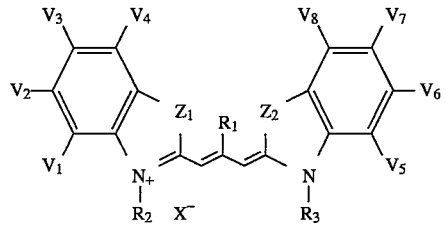

wherein $Z_1$ represents a sulfur or a selenium atom;

$Z_2$ represents a sulfur or selenium atom or —$NR_4$;

$R_1$ represents a hydrogen atom or an unsubstituted or substituted alkyl group;

$R_2$, $R_3$ and $R_4$ each independently represent an unsubstituted or substituted alkyl or alkenyl group of less than 18 carbon atoms;

$V_1$, $V_2$, $V_3$, $V_4$, $V_5$, $V_6$, $V_7$ and $V_8$ each represent a hydrogen atom, a halogen atom, an alkyl group, an alkyloxy group, an aryl group, a heterocyclic group, a cyano group, a hydroxy group, an amino group, a carbonamido group, a trifluoromethyl group, an acyloxy group, an alkylthio group or may be connected to form one or more additional aromatic rings; and X represents a counterion, if necessary to balance the overall charge of the dye.

13. A photographic element as claimed in claim 1, wherein said 2,4-disulfonamidophenol has the formula:

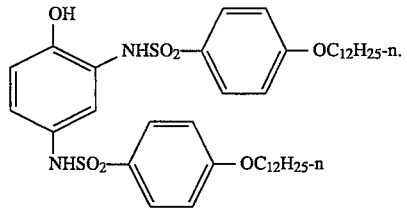

14. A photographic element as claimed in claim 1, wherein said 2,4-disulfonamidophenol has the formula:

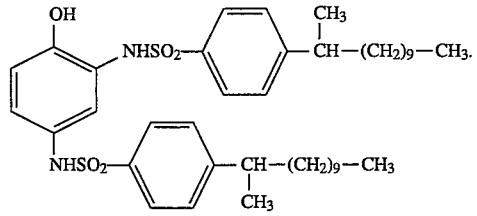

15. A photographic element as claimed in claim 1, wherein said ballasted amine has the formula:

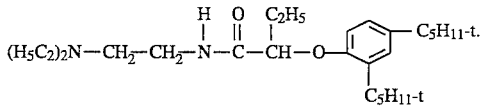

16. A photographic element as claimed in claim 1, wherein said ballasted amine has the formula:

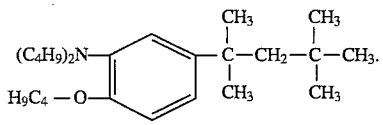

17. A photographic element as claimed in claim 1, wherein said ballasted amine has the formula:

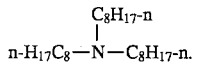

18. A photographic element as claimed in claim 1, wherein said ballasted amine has the formula:

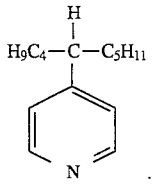

19. A photographic element as claimed in claim 1, wherein said ballasted amine has the formula:

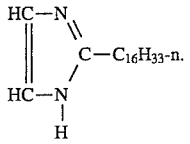

20. A photographic element as claimed in claim 1, wherein said ballasted amine has the formula:

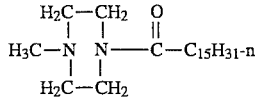

* * * * *